US009782993B2

(12) United States Patent
Landa et al.

(10) Patent No.: US 9,782,993 B2
(45) Date of Patent: Oct. 10, 2017

(54) RELEASE LAYER TREATMENT FORMULATIONS

(71) Applicant: LANDA CORPORATION LTD., Rehovot (IL)

(72) Inventors: Benzion Landa, Nes Ziona (IL); Sagi Abramovich, Ra'anana (IL); Gregory Nakhmanovich, Rishon LeZion (IL); Galia Golodetz, Rehovot (IL); Snir Dor, Petach Tikva (IL)

(73) Assignee: LANDA CORPORATION LTD., Rehovot ( * ) Notice: Subject to any disclaimer, the term of this patent is extended or adjusted under 35 U.S.C. 154(b) by 0 days.

(21) Appl. No.: 14/917,527

(22) PCT Filed: Sep. 11, 2014

(86) PCT No.: PCT/IB2014/064444

§ 371 (c)(1),
(2) Date: Mar. 8, 2016

(87) PCT Pub. No.: WO2015/036960

PCT Pub. Date: Mar. 19, 2015

(65) Prior Publication Data

US 2016/0207341 A1 Jul. 21, 2016

Related U.S. Application Data

(60) Provisional application No. 61/876,753, filed on Sep. 11, 2013.

(51) Int. Cl.
*B41M 5/52* (2006.01)
*B41M 5/025* (2006.01)
(Continued)

(52) U.S. Cl.
CPC ..... *B41M 5/52* (2013.01); *B41M 5/0256* (2013.01); *B41M 5/03* (2013.01); *B41M 5/5227* (2013.01);
(Continued)

(58) Field of Classification Search
CPC ..... B41M 5/52; B41M 5/0256; B41M 5/03; B41M 5/5227; B41M 5/5245; B41M 5/5254; B41M 5/5263; B41N 10/00
See application file for complete search history.

(56) References Cited

U.S. PATENT DOCUMENTS 3,697,551 A 10/1972 Thomson et al.
4,293,866 A 10/1981 Takita et al.
(Continued)

FOREIGN PATENT DOCUMENTS

CN 102925002 A 2/2013
EP 0499857 A1 * 8/1992 ..... C09D 11/102
(Continued)

OTHER PUBLICATIONS

Epomin Polyment, product information from Nippon Shokubai, dated Feb. 28, 2014.*
(Continued)

*Primary Examiner* — Nicholas Hill
(74) *Attorney, Agent, or Firm* — Daniel Feigelson; Fourth Dimension IP

(57) ABSTRACT

There is disclosed a formulation for use with an intermediate transfer member of an indirect printing system, including: (a) a carrier liquid: (b) a positively chargeable polymeric chemical agent having amine functional groups; and (c) a resolubilizing agent selected to improve resolubilization of said chemical agent. Method of use thereof is also provided.

18 Claims, 1 Drawing Sheet

(51) Int. Cl.
*B41M 5/03* (2006.01)
*B41N 10/00* (2006.01)

(52) U.S. Cl.
CPC ..... *B41M 5/5245* (2013.01); *B41M 5/5254* (2013.01); *B41M 5/5263* (2013.01); *B41N 10/00* (2013.01)

(56) References Cited

U.S. PATENT DOCUMENTS 4,401,500 A 8/1983 Hamada et al.
4,853,737 A 8/1989 Hartley et al.
5,039,339 A 8/1991 Phan et al.
5,099,256 A 3/1992 Anderson
5,106,417 A 4/1992 Hauser et al.
5,190,582 A 3/1993 Shinozuka et al.
5,352,507 A 10/1994 Bresson et al.
5,608,004 A 3/1997 Toyoda et al.
5,623,296 A 4/1997 Fujino et al.
5,679,463 A 10/1997 Visser et al.
5,723,242 A 3/1998 Lehman et al.
5,733,698 A 3/1998 Lehman et al.
5,736,250 A 4/1998 Heeks et al.
5,772,746 A 6/1998 Sawada et al.
5,859,076 A 1/1999 Kozma et al.
5,880,214 A 3/1999 Okuda et al.
5,883,144 A 3/1999 Bambara et al.
5,883,145 A 3/1999 Hurley et al.
5,884,559 A 3/1999 Okubo et al.
5,891,934 A 4/1999 Moffatt et al.
5,895,711 A 4/1999 Yamaki
5,902,841 A 5/1999 Jaeger et al.
5,923,929 A 7/1999 Ben Avraham et al.
5,929,129 A 7/1999 Feichtinger
5,932,659 A 8/1999 Bambara et al.
5,935,751 A 8/1999 Matsuoka et al.
6,004,647 A 12/1999 Bambara et al.
6,024,786 A 2/2000 Gore
6,045,817 A * 4/2000 Ananthapadmanabhan ..... A61K 8/42 424/400
6,053,438 A 4/2000 Romano, Jr. et al.
6,059,407 A 5/2000 Komatsu et al.
6,071,368 A 6/2000 Boyd et al.
6,102,538 A 8/2000 Ochi et al.
6,103,775 A 8/2000 Bambara et al.
6,143,807 A 11/2000 Lin
6,166,105 A 12/2000 Santilli et al.
6,196,674 B1 3/2001 Takemoto
6,214,894 B1 4/2001 Bambara et al.
6,221,928 B1 4/2001 Kozma et al.
6,242,503 B1 6/2001 Kozma et al.
6,257,716 B1 7/2001 Yanagawa
6,262,137 B1 7/2001 Kozma et al.
6,262,207 B1 7/2001 Rao et al.
6,303,215 B1 10/2001 Sonobe et al.
6,316,512 B1 11/2001 Bambara et al.
6,332,943 B1 12/2001 Herrmann et al.
6,357,870 B1 3/2002 Beach et al.
6,358,660 B1 3/2002 Agler et al.
6,383,278 B1 5/2002 Hirasa et al.
6,397,034 B1 5/2002 Tarnawskyj et al.
6,432,501 B1 8/2002 De Bastiani et al.
6,530,321 B2 3/2003 Andrew et al.
6,531,520 B1 3/2003 Bambara et al.
6,551,394 B2 4/2003 Hirasa et al.
6,551,716 B1 4/2003 Landa et al.
6,586,100 B1 7/2003 Pickering et al.
6,590,012 B2 7/2003 Miyabayashi
6,623,817 B1 9/2003 De Bastiani et al.
6,630,047 B2 10/2003 Hine et al.
6,682,189 B2 1/2004 May et al.
6,685,769 B1 2/2004 Karl et al.
6,709,096 B1 3/2004 Beach et al.
6,720,367 B2 4/2004 Taniguchi et al.
6,755,519 B2 6/2004 Gelbart et al.
6,770,331 B1 8/2004 Mielke et al.
6,789,887 B2 9/2004 Yang et al.
6,898,403 B2 5/2005 Baker et al.
6,916,862 B2 7/2005 Ota et al.
7,084,202 B2 8/2006 Pickering et al.
7,128,412 B2 10/2006 King et al.
7,160,377 B2 1/2007 Zoch et al.
7,271,213 B2 9/2007 Hoshida et al.
7,322,689 B2 1/2008 Kohne et al.
7,348,368 B2 3/2008 Kakiuchi et al.
7,612,125 B2 11/2009 Mueller et al.
7,655,707 B2 2/2010 Ma
7,655,708 B2 2/2010 House et al.
7,699,922 B2 4/2010 Breton et al.
7,709,074 B2 5/2010 Uchida et al.
7,712,890 B2 5/2010 Yahiro
7,732,543 B2 6/2010 Loch et al.
7,732,583 B2 6/2010 Annoura et al.
7,810,922 B2 10/2010 Gervasi et al.
7,867,327 B2 1/2011 Sano et al.
7,876,345 B2 1/2011 Houjou
7,910,183 B2 3/2011 Wu
7,919,544 B2 4/2011 Matsutama et al.
7,942,516 B2 5/2011 Ohara et al.
7,977,408 B2 7/2011 Matsuyama et al.
7,985,784 B2 7/2011 Kanaya et al.
8,012,538 B2 9/2011 Yokoushi
8,042,906 B2 10/2011 Chiwata et al.
8,177,351 B2 5/2012 Taniuchi et al.
8,186,820 B2 5/2012 Chiwata
8,192,904 B2 6/2012 Nagai et al.
8,215,762 B2 7/2012 Ageishi
8,242,201 B2 8/2012 Goto et al.
8,263,683 B2 9/2012 Gibson et al.
8,304,043 B2 11/2012 Nagashima et al.
8,460,450 B2 6/2013 Taverizatshy et al.
8,474,963 B2 7/2013 Hasegawa et al.
8,536,268 B2 9/2013 Karjala et al.
8,546,466 B2 10/2013 Yamashita et al.
8,556,400 B2 10/2013 Yatake et al.
8,714,731 B2 5/2014 Leung et al.
8,746,873 B2 6/2014 Tsukamoto et al.
8,779,027 B2 7/2014 Idemura et al.
8,802,221 B2 8/2014 Noguchi et al.
8,894,198 B2 11/2014 Hook et al.
8,919,946 B2 12/2014 Suzuki et al.
2002/0102374 A1 8/2002 Gervasi et al.
2002/0164494 A1 11/2002 Grant et al.
2002/0197481 A1 12/2002 Jing et al.
2003/0004025 A1 1/2003 Okuno et al.
2003/0018119 A1 1/2003 Frenkel et al.
2003/0032700 A1 2/2003 Morrison et al.
2003/0055129 A1 3/2003 Alford
2003/0118381 A1 6/2003 Law et al.
2003/0186147 A1 10/2003 Pickering et al.
2003/0232945 A1 12/2003 Pickering et al.
2003/0234849 A1 12/2003 Pan et al.
2004/0087707 A1 5/2004 Zoch et al.
2005/0031807 A1* 2/2005 Quintens ..... B41M 5/5254 428/32.38
2005/0110855 A1 5/2005 Taniuchi et al.
2005/0235870 A1 10/2005 Ishihara et al.
2005/0266332 A1 12/2005 Pavlisko et al.
2006/0135709 A1 6/2006 Hasegawa et al.
2006/0164488 A1 7/2006 Taniuchi et al.
2007/0146462 A1 6/2007 Taniuchi et al.
2007/0176995 A1 8/2007 Kadomatsu et al.
2007/0285486 A1 12/2007 Harris et al.
2007/0292780 A1 12/2007 Nagai et al.
2008/0006176 A1 1/2008 Houjou
2008/0032072 A1 2/2008 Taniuchi et al.
2008/0044587 A1 2/2008 Maeno et al.
2008/0055381 A1 3/2008 Doi et al.
2008/0055385 A1 3/2008 Houjou
2008/0138546 A1 6/2008 Soria et al.
2008/0166495 A1 7/2008 Maeno et al.
2008/0196621 A1 8/2008 Ikuno et al.
2009/0041932 A1 2/2009 Ishizuka et al.

(56) References Cited

U.S. PATENT DOCUMENTS

| | | | |
|---|---|---|---|
| 2009/0080949 | A1 | 3/2009 | Yamanobe et al. |
| 2009/0082503 | A1 | 3/2009 | Yanagi et al. |
| 2009/0087565 | A1 | 4/2009 | Houjou |
| 2009/0165937 | A1 | 7/2009 | Inoue |
| 2009/0211490 | A1 | 8/2009 | Ikuno et al. |
| 2009/0244146 | A1 | 10/2009 | Chiwata |
| 2009/0315926 | A1 | 12/2009 | Yamanobe |
| 2009/0317555 | A1 | 12/2009 | Hori |
| 2009/0318591 | A1 | 12/2009 | Ageishi et al. |
| 2010/0075843 | A1 | 3/2010 | Ikuno |
| 2010/0086692 | A1 | 4/2010 | Ohta |
| 2010/0247818 | A1 | 9/2010 | Wu |
| 2010/0282100 | A1 | 11/2010 | Okuda et al. |
| 2010/0285221 | A1 | 11/2010 | Oki et al. |
| 2011/0141188 | A1 | 6/2011 | Morita |
| 2011/0195260 | A1 | 8/2011 | Lee et al. |
| 2011/0234683 | A1 | 9/2011 | Komatsu |
| 2011/0234689 | A1 | 9/2011 | Saito |
| 2011/0269885 | A1 | 11/2011 | Imai |
| 2011/0279554 | A1 | 11/2011 | Dannhauser et al. |
| 2011/0304674 | A1 | 12/2011 | Sambhy et al. |
| 2012/0013694 | A1 | 1/2012 | Kanke |
| 2012/0026224 | A1 | 2/2012 | Anthony et al. |
| 2012/0105525 | A1 | 5/2012 | Leung et al. |
| 2012/0105561 | A1 | 5/2012 | Taniuchi et al. |
| 2012/0127250 | A1 | 5/2012 | Kanasugi et al. |
| 2012/0127251 | A1 | 5/2012 | Tsuji et al. |
| 2012/0140009 | A1 | 6/2012 | Kanasugi et al. |
| 2012/0156375 | A1 | 6/2012 | Brust et al. |
| 2013/0127966 | A1 | 5/2013 | Noguchi et al. |
| 2013/0338273 | A1 | 12/2013 | Shimanaka et al. |
| 2014/0043398 | A1 | 2/2014 | Butler et al. |
| 2015/0015650 | A1 | 1/2015 | Landa et al. |
| 2015/0022602 | A1 | 1/2015 | Landa et al. |
| 2015/0024180 | A1 | 1/2015 | Landa et al. |
| 2015/0024648 | A1 | 1/2015 | Landa et al. |
| 2015/0025179 | A1 | 1/2015 | Landa et al. |
| 2015/0044431 | A1 | 2/2015 | Landa et al. |
| 2015/0044437 | A1 | 2/2015 | Landa et al. |
| 2015/0072090 | A1 | 3/2015 | Landa et al. |
| 2015/0118503 | A1 | 4/2015 | Landa et al. |

FOREIGN PATENT DOCUMENTS

| | | | |
|---|---|---|---|
| EP | 1013466 | A2 | 6/2000 |
| EP | 1158029 | A1 | 11/2001 |
| EP | 2028238 | A2 | 2/2009 |
| EP | 2042317 | A1 | 4/2009 |
| JP | H08-62999 | A | 3/1996 |
| JP | 2000169772 | A | 6/2000 |
| JP | 2000206801 | A | 7/2000 |
| JP | 2002234243 | A | 8/2002 |
| JP | 2002371208 | A | 12/2002 |
| JP | 2003246135 | A | 9/2003 |
| JP | 2004114377 | A | 4/2004 |
| JP | 2004114675 | A | 4/2004 |
| JP | 2004231711 | A | 8/2004 |
| JP | 2004261975 | A | 9/2004 |
| JP | 2005014255 | A | 1/2005 |
| JP | 2005014256 | A | 1/2005 |
| JP | 2006102975 | A | 4/2006 |
| JP | 2006347081 | A | 12/2006 |
| JP | 2008006816 | A | 1/2008 |
| JP | 2008018716 | A | 1/2008 |
| JP | 2008142962 | A | 6/2008 |
| JP | 2008255135 | A | 10/2008 |
| JP | 2009045794 | A | 3/2009 |
| JP | 2009083317 | A | 4/2009 |
| JP | 2009154330 | A | 7/2009 |
| JP | 2009190375 | A | 8/2009 |
| JP | 2009202355 | A | 9/2009 |
| JP | 2009214318 | A | 9/2009 |
| JP | 2009-226852 | A | 10/2009 |
| JP | 2009226852 | A | 10/2009 |
| JP | 2009233977 | A | 10/2009 |
| JP | 2009234219 | A | 10/2009 |
| JP | 2010105365 | A | 5/2010 |
| JP | 2010173201 | A | 8/2010 |
| JP | 2010241073 | A | 10/2010 |
| JP | 2011025431 | A | 2/2011 |
| JP | 2011173325 | A | 9/2011 |
| JP | 2011201951 | A | 10/2011 |
| JP | 2012086499 | A | 5/2012 |
| WO | 1986000327 | A2 | 1/1986 |
| WO | 02/068191 | A1 | 9/2002 |
| WO | 2013132418 | A2 | 9/2013 |

OTHER PUBLICATIONS

JP 2000206801 Machine Translation (by PlatPat English machine translation)—published Jul. 28, 2000 Kobayashi et al.
JP 2003246135 Machine Translation (by PlatPat English machine translation)—published Sep. 2, 2003 Morohoshi et al.
JP 2004261975 Machine Translation (by PlatPat English machine translation)—published Sep. 24, 2004 Kataoka et al.
JP 2011201951 Machine Translation (by PlatPat English machine translation)—published Oct. 13, 2011 Todoroki et al.
JP H08-62999 Machine Translation (by EPO & Google)—published Mar. 8, 1996 Yoshida, Tomoyuki.
JP 2009-226852 Machine Translation (by EPO & Google)—published Oct. 8, 2009 Katsuyuki, Hirato.
BASF , "JONCRYL ? 537", Datasheet , Retrieved from the internet: Mar. 23, 2007 Mar. 23, 2007 (Mar. 23, 2007) p. 1.
Supplemental European Search Report for EP 13757427.3 dated Mar. 19, 2015.
Thomas E. Furia "CRC Handbook of Food Additives, Second Edition, vol. 1" CRC Press LLC, p. 231 (1972).
CN 102925002 Machine Translation (by EPO and Google)—published Feb. 13, 2013; Jiangnan University.
JP 2000-169772 Machine Translation (by EPO and Google)—published Jun. 20, 2000; Tokyo Ink MFG Co Ltd.
JP 2002-234243 Machine Translation (by EPO and Google)—published Aug. 20, 2002; Hitachi Koki Co Ltd.
JP 2002-371208 Machine Translation (by EPO and Google)—published Dec. 26, 2002; Canon Inc.
JP 2004-114377 Machine Translation (by EPO and Google)—published Apr. 14, 2004; Konica Minolta Holdings Inc, et al.
JP 2004-114675 Machine Translation (by EPO and Google)—published Apr. 15, 2004; Canon Inc.
JP 2004-231711 Machine Translation (by EPO and Google)—published Aug 19, 2004; Seiko Epson Corp.
JP 2005-014255 Machine Translation (by EPO and Google)—published Jan. 20, 2005; Canon Inc.
JP 2005-014256 Machine Translation (by EPO and Google)—published Jan. 20, 2005; Canon Inc.
JP 2006-102975 Machine Translation (by EPO and Google)—published Apr. 20, 2006; Fuji Photo Film Co Ltd.
JP 2006-347081 Machine Translation (by EPO and Google)—published Dec. 28, 2006; Fuji Xerox Co Ltd.
JP 2008-006816 Machine Translation (by EPO and Google)—published Jan. 17, 2008; Fujifilm Corp.
JP 2008-018716 Machine Translation (by EPO and Google)—published Jan. 31, 2008; Canon Inc.
JP 2008-142962 Machine Translation (by EPO and Google)—published Jun. 26, 2008; Fuji Xerox Co Ltd.
JP 2008-255135 Machine Translation (by EPO and Google)—published Oct. 23, 2008; Fujifilm Corp.
JP 2009-045794 Machine Translation (by EPO and Google)—published Mar. 5, 2009; Fujifilm Corp.
JP 2009-083317 Abstract; Machine Translation (by EPO and Google)—published Apr. 23, 2009; Fujifilm Corp.
JP 2009-154330 Machine Translation (by EPO and Google)—published Jul. 16, 2009; Seiko Epson Corp.
JP 2009-190375 Machine Translation (by EPO and Google)—published Aug. 27, 2009; Fuji Xerox Co Ltd.
JP 2009-202355 Machine Translation (by EPO and Google)—published Sep. 10, 2009; Fuji Xerox Co Ltd.

(56) References Cited

OTHER PUBLICATIONS

JP 2009-214318 Machine Translation (by EPO and Google)—published Sep. 24, 2009 Fuji Xerox Co Ltd.
JP 2009-226852 Machine Translation (by EPO and Google)—published Oct. 8, 2009; Fujifilm Corp.
JP 2009-233977 Machine Translation (by EPO and Google)—published Oct. 15, 2009; Fuji Xerox Co Ltd.
JP 2009-234219 Machine Translation (by EPO and Google)—published Oct. 15, 2009; Fujifilm Corp.
JP 2010-105365 Machine Translation (by EPO and Google)—published May 13, 2010; Fuji Xerox Co Ltd.
JP 2010-173201 Abstract; Machine Translation (by EPO and Google)—published Aug. 12, 2010; Richo Co Ltd.
JP 2010-241073 Machine Translation (by EPO and Google)—published Oct. 28, 2010; Canon Inc.
JP 2011-025431 Machine Translation (by EPO and Google)—published Feb. 10, 2011; Fuji Xerox Co Ltd.
JP 2011-173325 Abstract; Machine Translation (by EPO and Google)—published Sep. 8, 2011; Canon Inc.
JP 2012-086499 Machine Translation (by EPO and Google)—published May 10, 2012; Canon Inc.
International Search Report for PCT/IB2013/051755 published as W02013132439.
Written Opinion for PCT/IB2013/051755 published as W02013132439.
IPRP for PCT/IB2013/051755 published as W02013132439.
International Search Report for PCT/IB2013/000782 published as WO2013132340.
Written Opinion for PCT/IB2013/000782 published as WO2013132340.
IPRP for PCT/IB2013/000782 published as WO2013132340.
Office Action for US 14382881 dated Dec. 16, 2014.
European Search Report for EP 13757427.3 dated Mar. 19, 2015.

* cited by examiner

RELEASE LAYER TREATMENT FORMULATIONS

FIELD AND BACKGROUND

The present invention relates to indirect printing systems and more particularly to compositions suitable for the treatment of intermediate transfer members.

Digital printing techniques have been developed that allow a printer to receive instructions directly from a computer without the need to prepare printing plates. Amongst such printing devices are printers with color laser technology or the xerographic process, which use dry toners, and the widely used inkjet printers, which use liquid inks and rely on inkjet or bubble jet processes. Such printing devices typically directly apply the desired image to the final printing substrate (e.g., paper, cardboard or plastic). In general, the resolution of such processes is limited. For instance, liquid inks may wick into fibrous substrates requiring the use of substrates specially coated to absorb the liquid ink in a controlled fashion or to prevent its penetration below the surface of the substrate. Such coated substrates may not address all issues associated with direct printing and may even create their own problems. For instance, if the surface of the substrate remains wet following the application of the ink, additional costly and time consuming steps may be needed to dry the ink, so that it is not later smeared as the substrate is being handled, for example, stacked or wound into a roll. Furthermore, excessive wetting of the substrate causes cockling and makes printing on both sides of the substrate (also termed perfecting or duplex printing) difficult, if not impossible.

In commercial settings, there exist additional printing systems, some relying on indirect or offset printing techniques. In such processes, an intermediate image of the final desired pattern (e.g., a mirror image) is typically formed on an image transfer member (e.g., a blanket or a drum) and transferred therefrom to the final printing substrate. The intermediate image can be, as in HP-Indigo printers, an electrostatic image produced on an electrically charged image bearing cylinder by exposure of compatible oil-based inks to laser light, the ink image being then transferred by way of a blanket cylinder onto paper or any other substrate. Though such systems are better suited for high quality digital printing the use of oil-based inks has raised environmental concerns.

The present Applicant has recently disclosed a printing process wherein inks having an aqueous carrier are jetted onto an intermediate transfer member (ITM) at an image forming station and dried thereupon before being transferred to the desired substrate at an impression station. Few systems implementing such process were disclosed, differing among other things in the number of image forming stations, the configurations of the intermediate transfer members, the number of impression stations and the system architecture allowing duplex printing. More details on such systems are disclosed in PCT Publication Nos. WO 2013/132418, WO 2013/132419 and WO 2013/132420.

Advantageously, such indirect printing systems allow the distance between the outer surface of the intermediate image transfer member (also called the release layer) and the inkjet print head to be maintained constant and reduces wetting of the substrate, as the ink can be dried on the intermediate image transfer member before being applied to the printing substrate. Consequently, the final image quality is less affected by the physical properties of the substrate and benefits from various other advantages as disclosed in PCT Publication Nos. WO 2013/132345, WO 2013/132343 and WO 2013/132340 by the present Applicant.

Among the problems surmounted by such systems was the need to find a balance between opposite requirements. On the one hand, the printing process, including the materials or formulations employed therewith, should allow transiently fixing the aqueous based ink droplets onto the release layer at the image forming station. On the other hand, the same should allow the dried ink film to be fully transferred to the printing substrate at the impression station.

Generally, silicone coated transfer members are preferred, since they facilitate transfer of the dried image to the final substrate. However, silicone is hydrophobic, which causes water based ink droplets to bead on the transfer member. This results in a small contact area between the droplets and the blanket that may renders the ink image unstable during rapid movement and may makes it more difficult to remove the water from the ink, for instance by heating the transfer member.

One solution proposed in the above-referenced publications of the Applicant to alleviate this problem was to "freeze" the shape of the impinging jetted droplet in the pancake-like form it adopted upon contact, for instance by rapidly evaporating a substantial proportion of the liquid ink carrier at the stage of the image formation onto the transfer member. The rate of such evaporation depending upon temperature, it was generally preferred for that particular purpose to operate the system at elevated temperatures (e.g., above water boiling point and typically up to 160° C.). However, as the vapors of the ink carrier might over time affect the print head nozzles, lower temperatures (e.g., above 40° C.) were also considered for the image forming station.

Alternatively, or additionally, the Applicant disclosed conditioning methods and formulations facilitating the desired interaction between ink formulations and materials composing the release layer suitable for the novel process, by pre-treatment of the transfer member ahead of ink jetting. More details on such methods can be found in PCT Publication No. WO 2013/132339.

Without detracting from the importance of these advances, the present inventors have discovered that under some conditions, surprisingly, some of the aforementioned conditioning solutions may deleteriously accumulate on the transfer member on selected areas. Hence, the present inventors have recognized the need for further improvements in release layer conditioning compositions and technologies.

SUMMARY

There is disclosed a formulation for use with an intermediate transfer member of a printing system, the formulation comprising: (a) a carrier liquid; (b) a positively chargeable polymeric chemical agent selected from the group consisting of polyethylene imine (PEI), a cationic guar or guar-based polymer and a cationic methacrylamide or methacrylamide-based polymer; and (c) a resolubilizing agent selected to improve resolubilization of the chemical agent; the polymeric chemical agent and the resolubilizing agent being disposed within the carrier liquid; the polymeric chemical agent having an average molecular weight of at least 10,000 and a positive charge density of at least 0.1 meq/g of the chemical agent; the resolubilizing agent having, in a pure state and at 90° C., a vapor pressure of less than 0.5 kPa; and the weight ratio of the resolubilizing agent to the polymeric chemical agent, within the formulation, being at least 1:10.

In some embodiments, the resolubilizing agent of the formulation herein disclosed has a hydrogen-bonding functional group. In some embodiments, a functional group density of the hydrogen-bonding functional group within the resolubilizing agent is at least 0.25 meq/g, at least 0.35 meq/g, at least 0.45 meq/g, at least 0.6 meq/g, at least 0.8 meq/g, at least 1 meq/g, at least 2 meq/g, at least 3 meq/g, at least 5 meq/g, at least 7 meq/g, at least 10 meq/g, at least 15 meq/g, at least 20 meq/g, at least 22 meq/g, at least 24 meq/g, at least 26 meq/g, at least 28 meq/g, or at least 30 meq/g.

In some embodiments, the resolubilizing agent has at least one functional group selected from a hydroxyl group, an amine group, an ether group, a sulfonate group, and combinations thereof.

In some embodiments, the resolubilizing agent is selected from the group including diols, triols, polyols, alcohols, sugars and modified sugars, ethers, polyethers, amino alcohol, amino silicones, styrene sulfortates, and combinations thereof.

In some embodiments, the resolubilizing agent is selected from the group consisting of cocoamide diethanol amine, ethoxylated methyl glucose ether, Glucam™ E-10, Glucam™ E-20, glycerol, pentaerythritol, PEG 400, PEG 600, poly(sodium-4-styrenesulfonate), SilSense® Q-Plus Silicone, SilSense® A21 Silicone, sucrose, triethanol amine, and triethylene glycol monomethyl ether.

In some embodiments, the resolubilizing agent has a molecular weight below 5,000, below 2,500, below 1,000, below 750, below 600, below 500, below 400, below 350, or below 300.

In some embodiments, the resolubilizing agent of the formulation herein disclosed has a solubility, in the formulation, of at least 1%, at least 3%, at least 5%, at least 10%, at least 20%, at least 30%, at least 40%, at least 50% at 25° C.

In some embodiments, the chemical agent, the resolubilizing agent, and the carrier liquid make up at least 80%, at least 90%, at least 95%, at least 97%, or at least 99% of the formulation, by weight.

In some embodiments, the water content of the formulation is at least 5%, at least 10%, at least 20%, at least 40%, at least 60%, at least 70%, at least 80%, at least 90%, at least 95%, at least 97%, by weight.

In some embodiments, the weight ratio of the resolubilizing agent to the polymeric chemical agent is at least 1:7, at least 1:5, at least 1:4, at least 1:3, at least 1:2, at least 1:1, at least 2:3, at least 2:1, at least 3:1, at least 4:1, at least 6:1, at least 8:1, at least 10:1, at least 12:1, at least 15:1, or at least 20:1.

In some embodiments, the weight ratio of the resolubilizing agent to the polymeric chemical agent is less than 20:1, less than 15:1 less than 12:1, less than 10:1, less than 8:1, less than 6:1, less than 5:1, less than 4:1, less than 3:1, less than 2:1, less than 3:2, or less than 5:4.

In some embodiments, the weight ratio of the resolubilizing agent to the polymeric chemical agent being within a range of 1:10 to 20:1, within a range of 1:7 to 20:1, within a range of 1:5 to 15:1, within a range of 1:2 to 15:1, within a range of 1:2 to 10:1, within a range of 1:2 to 7:1, within a range of 1:2 to 5:1, within a range of 1:2 to 4:1, within a range of 1:1 to 10:1, within a range of 1:1 to 7:1, within a range of 1:1 to 5:1, or within a range of 1:2 to 3:1.

In some embodiments, the formulation has a viscosity of at most 1,500 cP, at most 1000 cP, at most 700 cP, at most 400 cP, at most 200 cP, at most 100 cP, at most 50 cP, at most 30 cP, at most 20 cP, at most 10 cP, or at most 1 cP.

In some embodiments, the formulation has a pH within a range of 7 to 14, 8 to 13, or 9 to 12.

In some embodiments, the vapor pressure of the resolubilizing agent is less than 0.45 kPa, less than 0.40 kPa, less than 0.35 kPa, less than 0.30 kPa, less than 0.20 kPa, less than 0.10 kPa, or less than 0.05 kPa.

In some embodiments, the resolubilizing agent is stable at a temperature of up to at least 125° C., at least 150° C., at least 175° C., at least 200° C., or at least 225° C. In some embodiments, the formulation is stable at a temperature of up to at least 125° C., at least 150° C., at least 175° C., at least 200° C., or at least 225° C.

In some embodiments, the concentration of the polymeric chemical agent within the formulation is not more than 5 wt. %, not more than 4 wt. %, not more than 3 wt. %, not more than 2 wt. %, not more than 1 wt. %, not more than 0.5 wt. %, not more than 0.4 wt. %, not more than 0.3 wt. %, not more than 0.2 wt. %, not more than 0.1 wt. %, not more than 0.05 wt. %, or not more than 0.01 wt. %.

In some embodiments, the concentration of the resolubilizing agent within the formulation is not more than 5 wt. %, not more than 4 wt. %, not more than 3 wt. %, not more than 2 wt. %, not more than 1 wt. %, not more than 0.5 wt. %, not more than 0.4 wt. %, not more than 0.3 wt. %, not more than 0.2 wt. %, not more than 0.1 wt. %, not more than 0.05 wt. %, or not more than 0.01 wt. %.

In some embodiments, the polymeric chemical agent has a nitrogen content of at least 1 wt. %.

In some embodiments, the polymeric chemical agent includes, largely includes, or consists essentially of linear polyethylene imine (PEI), branched PEI, modified PEI and combinations thereof. In some embodiments, the average molecular weight (MW) of the PEI is at least 24,500, at least 50,000, at least 100,000, at least 150,000, at least 200,000, at least 250,000, at least 500,000, at least 750,000, at least 1,000,000, or at least 2,000,000.

In some embodiments, the charge density of the PEI is at least 10 meq/g, at least 11 meq/g, at least 12 meq/g, at least 13 meq/g, at least 14 meq/g, at least 15 meq/g, at least 16 meq/g, at least 17 meq/g, at least 18 meq/g, at least 19 meq/g, or at least 20 meq/g.

In some embodiments, the polymeric chemical agent has at least one of the following structural properties: (a) its positive charge density is at least 3 meq/g and its average molecular weight being at least 5,000; (b) its positive charge density is at least 3 meq/g and its average molecular weight is at least 1000; (c) the average molecular weight of the chemical agent is at least 50,000; and (d) a nitrogen content of at least 18% and an average molecular weight of at least 10,000.

In some embodiments, the polymeric chemical agent has an average molecular weight of at least 800, at least 1,000, at least 1,300, at least 1,700, at least 2,000, at least 2,500, at least 3,000, at least 3,500, at least 4,000, at least 4,500, at least 5,000, of at least 10,000, at least 15,000, at least 20,000, at least 25,000, at least 50,000, at least 100,000, at least 150,000, at least 200,000, at least 250,000, at least 500,000, at least 750,000, at least 1,000,000, or at least 2,000,000.

In some embodiments, the polymeric chemical agent is selected from the group consisting of a vinyl pyrrolidone-dimethylaminopropyl methacrylamide co-polymer (ViviPrint™ 131), a vinyl caprolactam-dimethylaminopropyl methacrylamide hydroxyethyl methacrylate terpolymer (ViviPrint™ 200), a quaternized copolymer of vinyl pyrrolidone and dimethylaminoethyl methacrylate with diethyl sulfate (ViviPrint™ 650), a guar hydroxypropyltrimonium chloride, a hydroxypropyl guar hydroxypropyltrimonium chloride, and combinations thereof.

In some embodiments, the positively chargeable polymeric chemical agent includes at least one of a cationic [guar-based] polymer and of a cationic [methacrylamide-based] polymer, and the functional group density within said polymeric chemical agent is at least 0.25 meq/g, at least 0.35 meq/g, at least 0.45 meq/g, at least 0.6 meq/g, at least 0.8 meq/g, at least 1 meq/g, at least 2 meq/g, at least 3 meq/q, or at least 5 meq/g.

There is also provided a formulation for use with an intermediate transfer member of a printing system, the formulation comprising: (a) a carrier liquid; (b) a positively chargeable polymeric chemical agent; and (c) a resolubilizing agent selected to improve resolubilization of said chemical agent; the polymeric chemical agent and the resolubilizing agent disposed within the carrier liquid; wherein the polymeric chemical agent has (i) at least one functional group selected from a primary amine, a secondary amine, a tertiary amine and a quaternary amine, (ii) an average molecular weight of at least 50,000 and (iii) a positive charge density of at least 0.1 meq/g of the chemical agent; the resolubilizing agent having, in a pure state and at 90° C., a vapor pressure of less than 0.5 kPa; and wherein a weight ratio of the resolubilizing agent to the polymeric chemical agent, within the formulation, is at least 1:10.

According to some embodiments, the chemical agent is selected from the group consisting of linear PEI, branched PEI, modified PEI, and combinations thereof, and the weight ratio of the resolubilizing agent to the PEI, within the formulation, is at most 20:1.

Also provided is a method of use of the above described formulations, the method comprising (a) treating an intermediate transfer member (ITM) of a printing system by application of the formulation upon a release surface, the treatment preceding the deposition of an ink image upon the transfer member. The method may further comprise one or more of the following steps: (b) drying the ink image deposited on the ITM, (c) transferring the dried ink image to a printing substrate.

BRIEF DESCRIPTION OF THE DRAWINGS

The present technology is herein described, by way of example only, with reference to the accompanying drawings, in which the dimensions of components and features are chosen for convenience and clarity of presentation and are not necessarily to scale, and wherein.

DETAILED DESCRIPTION

Figure 1:
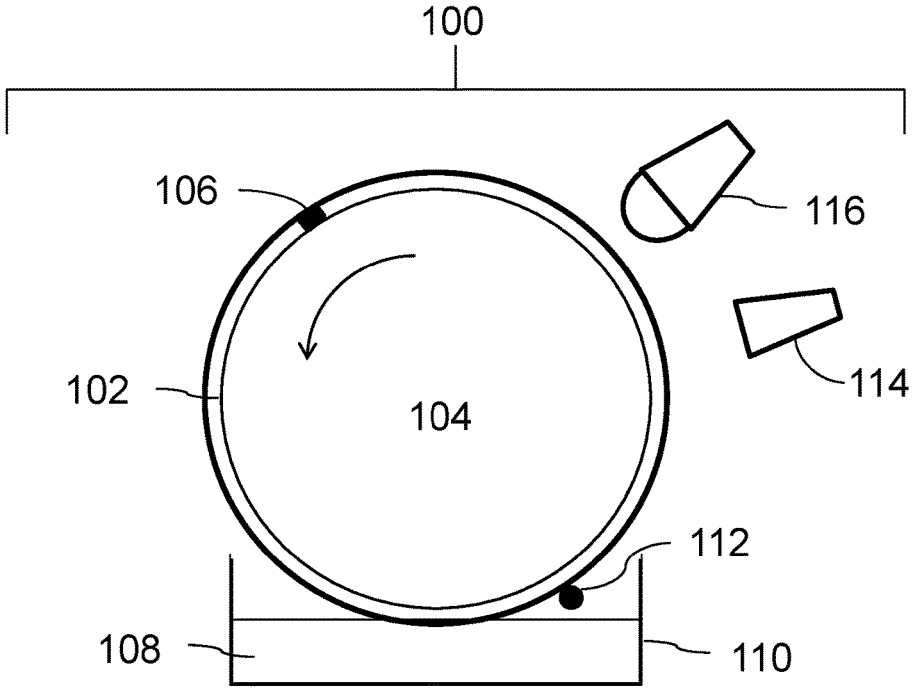
FIG. 1 is a schematic illustration of an experimental setup allowing assessing accumulation of conditioning agents on printing blankets and its reduction in accordance with an embodiment herein disclosed.

As noted, when the ink droplet impinges on the transfer member, the momentum in the droplet causes it to spread into a relatively flat volume. In the prior art, this flattening of the droplet is almost immediately counteracted by the combination of surface tension of the droplet and the hydrophobic nature of the surface of the transfer member, which causes the droplet to bead up regaining spherical shape.

In some instances, the shape of the ink droplet is "frozen" such that at least some and preferably a major part of the flattening and horizontal extension of the droplet present on impact is preserved. It should be understood that since the recovery of the droplet shape after impact is very fast, the methods of the prior art would not effect phase change by agglomeration and/or coagulation and/or migration.

Without wishing to be bound by theory, it is believed that, on impact, the positive charms which have been placed on the surface of the transfer member attract the negatively charged or chargeable polymer resin particles of the ink droplet that are immediately adjacent to the surface of the member. It is believed that, as the droplet spreads, this effect takes place along a sufficient area of the interface between the spread droplet and the transfer member to retard or prevent the beading of the droplet, at least on the time scale of the printing process, which is generally on the order of seconds.

As the amount of charge is too small to attract more than a small number of charged resin particles in the ink, it is believed that the concentration and distribution of the charged resin particles in the drop is not substantially changed as a result of contact with the chemical agent on the release layer. Furthermore, since the ink is aqueous, the effects of the positive charge are very local, especially in the very short time span needed for freezing the shape of the droplets.

Without wishing to be bound by theory, it is believed that in applying a conditioning agent or solution to the surface of the intermediate transfer member, at least one type of positively-charged functional group of the conditioning agent is adsorbed onto, or otherwise attached to, the surface of the release layer. On the opposite side of the release layer, facing the jetted ink drops, at least one type of positively-charged functional group of the conditioning agent is available and positioned to interact with the negatively charged molecules in the ink (e.g., in the resin).

The polymeric resin typically comprised in ink formulations due to interact with such transfer members comprises primarily or exclusively one or more negatively chargeable polymers, such as polyanionic polymers. By a "negatively chargeable polymer" or "negatively chargeable polymer resin" is meant a polymer or polymeric resin which has at least one proton which can easily be removed to yield a negative charge; as used herein, the term refers to an inherent property of the polymer, and thus may encompass polymers which are in an environment in which such protons are removed, as well as polymers in an environment in which such protons are not removed.

In contrast, the term "a negatively charged polymer resin" refers to a resin in an environment in which one or more such protons have been removed. Examples of negatively chargeable groups are carboxylic acid groups (—COOH), including acrylic acid groups ($—CH_2{=}CH—COOH$) and methacrylic acid groups ($—CH_2{=}C(CH_3)—COOH$), and sulfonic acid groups ($—SO_3H$). Such groups can be covalently bound to polymeric backbones; for example styrene-acrylic copolymer resins have carboxylic acid functional groups which readily lose protons to yield negatively-charged moieties. Many polymers suitable for use in inks that may benefit from conditioning solutions according to embodiments of the invention, will be negatively charged when dissolved in water; others may require the presence of a pH raising compound to be negatively charged. Commonly, polymers will have many such negatively chargeable groups on a single polymer molecule, and thus are referred to as polyanionic polymers.

Examples of polyanionic polymers include, for instance, polysulfonates such as polyvinylsulfonates, poly(styrenesulfonates) such as poly(sodium styrenesulfonate) (PSS), sulfonated poly(tetrafluoroethylene), polysulfates such as polyvinylsulfates, polycarboxylates such as acrylic acid polymers and salts thereof (e.g., ammonium, potassium, sodium, etc.), for instance, those available from BASF and DSM Resins, methacrylic acid polymers and salts thereof (e.g., EUDRAGIT®, a methacrylic acid and ethyl acrylate copolymer), carboxymethylcellulose, carboxymethylamylose and carboxylic acid derivatives of various other polymers, polyanionic peptides and proteins such as homopolymers and copolymers of acidic amino acids such as glutamic acid, aspartic acid or combinations thereof, homopolymers and copolymers of uronic acids such as mannuronic acid, galacturonic acid and guluronic acid, and their salts, alginic acid and its salts, hyaluronic acid and its salts, gelatin, carrageenan, polyphosphates such as phosphoric acid derivatives of various polymers, polyphosphonates such as polyvinylphosphonates, as well as copolymers, salts, derivatives, and combinations of the preceding, among various others. In some embodiments, the polymeric resin comprises an acrylic-based polymer, viz. a polymer or copolymer made from acrylic acid or an acrylic acid derivative (e.g., methacrylic acid or an acrylic acid ester), such as polyacrylic acid or an acrylic acid-styrene copolymer. Nominally, the polymeric resin may be, or include, an acrylic styrene copolymer. In some illustrated embodiments, conditioning solutions according to the invention satisfactorily treat release layer upon which inks comprising primarily or exclusively an acrylic-based polymer selected from an acrylic polymer and an acrylic-styrene copolymer are deposited. In some instances, the polymeric resin is at least partly water soluble; in some instances, the polymeric resin is water dispersible, and may be provided as an emulsion or a colloid.

Intermediate transfer members amenable to such treatment may include in their release layer, by way of example, silanol-, sylyl- or silane-modified or terminated polydialkylsiloxane silicones, or combinations thereof. Transfer members having such non-limiting exemplary release layers have been disclosed in PCT Publication No. WO 2013/132432.

Chemical agents suitable for the preparation of such conditioning solutions, if required, have relatively high charge density and can be polymers containing amine nitrogen atoms in a plurality of functional groups, which need not be the same, and can be combined (e.g., primary, secondary, tertiary amines or quaternary ammonium salts). Though macromolecules having a molecular weight from several hundred to several thousand may be suitable conditioning agents, the inventors believe that polymers having a high molecular weight of 10,000 g/mole or more are preferable. Suitable conditioning agents may include guar hydroxylpropyltrimonium chloride, hydroxypropyl guar hydroxypropyltrimonium chloride, linear or branched polyethylene imine, modified polyethylene imine, vinyl pyrrolidone dimethylaminopropyl methacrylamide copolymer, vinyl caprolactam dimethylaminopropyl methacrylamide hydroxyethyl methacrylate, quaternized vinyl pyrrolidone dimethylaminoethyl methacrylate copolymer, poly(diallyldimethyl-ammonium chloride), poly(4-vinylpyridine) and polyallylamine.

Further details on conditioning solutions suitable for printing processes wherein water-based inks are jetted onto hydrophobic surface of transfer members and which may be used in printing systems for which the present invention can be suitable are disclosed in PCT Publication No. WO 2013/132339.

The efficacy of this method and of the water-based treating solutions associated therewith, also termed "conditioning solutions", was established in laboratory experimental setups and in preliminary pilot printing experiments. As disclosed in the above-mentioned application, the use of such solutions was highly beneficial, as assessed by the print quality of the image following its transfer from the intermediate transfer member to the printing substrate. The optical density of the printed matter was considered of particular relevance and the use of such method of blanket treatment prior to ink jetting clearly improved the measured outcome on the printing substrate. For example, when the substrate was Condat Gloss® 135 gsm coated paper, the optical density of the printed image on the substrate was at least 50% greater than the optical density of the same image when printed under identical conditions but without application of the chemical agent to the release layer. In some embodiments of the method, the optical density (as measured using a Spectrodensitometer (500 Series from X-rite)) is at least 60% greater, at least 70% greater, at least 80% greater, or at least 90% greater. In some embodiments, the optical density is at least 100% greater, at least 150% greater, at least 200% greater, at least 250% greater, at least 300% greater, at least 350% greater, at least 400% greater, at least 450% greater, at least 500% greater, at least 600% greater.

According to the method originally developed by the Applicant, a very thin coating of conditioning solution was applied to the transfer member, immediately removed and evaporated, leaving no more than few layers of the suitable chemical agent. Ink droplets were jetted on such pre-treated blanket, dried and transferred to the printing substrate. Typically, the ink film image so printed could be identified by the presence on their outer surface of the conditioning agent. In other words, the dried ink droplet upon transfer ripped the underlayer of conditioning agent and was impressed on the final substrate in inversed orientation.

It was expected that untransferred residues of conditioning agents (e.g., in areas where no ink was jetted), would readily redissolve in the next cycle, upon the application of a fresh coating of conditioning solution. The operating temperature of the process, which may vary at the different stations along the path the jetted image would follow, but would typically be above 50° C., was expected to facilitate such resolubilization of the residual conditioning agents, if any, in the freshly applied solution. In addition, any such residue was expected to be readily eliminated during cleaning of the transfer member that could take place, if desired, to remove dirt or traces of ink residues that may gather on such member following repeated printing cycles.

In the field, numerous operative parameters were tested, such that the number of runs being performed under a given set of variables was relatively limited, i.e., up to 1,500-3,000 impression repeats. However, upon repeated use of this method in pilot experiments of longer runs (e.g., at least 5,000-10,000 impressions), various undesirable phenomena were found to occur. Perhaps most significantly, the inventors discovered that various above-provided conditioning agents, though based on water-soluble polymers, did not—once dried on the ITM—resolubilize satisfactorily when subjected to a subsequent application of the conditioning solution.

In addition, the inventors have found that low-temperature operation of the image forming station may appreciably complicate or increase the difficulty of the conditioning duty. Without wishing to be limited by theory, the inventors believe that at higher temperatures, the evaporation of the carrier of the ink formulation proceeds at a relatively high rate, which reduces the requisite duty of the conditioning agents with respect to the retardation of droplet beading.

However, at lower operating temperatures, the evaporation kinetics may be significantly slower, as are the kinetics for the attraction process between the positively-charged conditioning agents and the negatively-charged functional groups in the ink (typically in the resin).

Moreover, the inventors believe that the kinetics of resolubilization may also be appreciably reduced at lower temperatures, which as elaborated hereinabove, may detract from print image quality.

As the previously disclosed conditioning solutions could lead to undesired build up of chemical agents having unexpectedly low resolubilization properties, the practical lifetime of the ITM (e.g., the blanket) was shortened, in order to ensure that the surface of the release layer was fresh, or at least sufficiently devoid of such deleterious accumulations to enable satisfactory transfer and print quality. Such accumulations were generally observed on areas of low to null ink coverage (e.g., ink barren areas of a printed image).

The inventors have surprisingly discovered aqueous formulations that act as a conditioning solution, and that facilitate resolubilization of chemical agents (also referred to as "residual conditioning agents"). In some embodiments, the aqueous conditioning formulation may be sufficiently active, at low temperatures (Image Forming Station temperatures within a range of 40° C. to 95° C., 60° C. to 95° C., 75° C. to 95° C., 60° C. to 90° C., or 60° C. to 85° C.) to efficaciously interact with various negatively charged molecules in the ink, within the requisite time frame (at most a few seconds), such that beading of the droplet is sufficiently retarded.

The inventive aqueous conditioning formulation may include: a positively chargeable polymeric conditioning agent, typically having an amine functional group, such as a polyethylene imine (PEI), and a resolubilizing agent selected to improve resolubilization of the conditioning agent, both disposed within an aqueous carrier liquid. Typically, the PEI has an average molecular weight of at least 5,000 and a positive charge density of at least 10 meq/g. Other conditioning agents are amenable to improved resolubilization according to the teaching of the invention, as detailed hereinbelow, and though the invention is described with reference to PEI, the invention need not be limited to such particular embodiments. The resolubilizing agent may advantageously have, in a pure state, a vapor pressure of less than 0.025, less than 0.020, less than 0.015, less than 0.012, less than 0.010, or less than 0.008 bar at 90° C.

The resolubilizing agent, as a pure substance, may advantageously be a liquid at 20° C. or more, at 30° C. or more, at 40° C. or more, at 50° C. or more, or at 60° C. or more. Without wishing to be bound by a particular theory, it is believed that suitable resolubilizing agents may interact with the conditioning agent by way of steric hindrance, increasing the accessibility of the conditioning molecule to resolubilizing vehicles (e.g., water). The two agents are preferably chemically inert with one another.

The weight ratio of the resolubilizing agent to the conditioning agent (e.g., PEI), within the conditioning formulation, is typically within a range of 1:10 to 20:1, within a range of 1:5 to 20:1, within a range of 1:5 to 15:1, and more typically, within a range of 1:3 to 10:1, within a range of 1:3 to 7:1, within a range of 1:3 to 5:1, within a range of 1:2 to 5:1, or within a range of 1:1 to 5:1.

In some embodiments, the concentration of the resolubilizing agent within the formulation may be not more than 10 wt. %, not more than 5 wt. %, not more than 4 wt. %, not more than 3 wt. %, not more than 2 wt. %, not more than 1 wt. %, not more than 0.5 wt. %, not more than 0.4 wt. %, not more than 0.3 wt. %, not more than 0.2 wt. %, or not more than 0.1 wt. %.

The resolubilizing agent may have a solubility in water, in the carrier liquid, or in the formulation, of at least 1%, at least 3%, at least 5%, at least 10%, at least 20%, at least 30%, at least 40%, at least 50% at 25° C. and a pH of 7. The conditioning agent (e.g., PEI), resolubilizing agent, and carrier liquid may make up at least 50%, at least 60%, at least 70%, at least 80%, at least 90%, at least 95%, at least 97%, or at least 99% of the formulation, by weight.

The PEI may be a linear polyethylene imine, a branched polyethylene imine, a modified polyethylene imine, or combinations thereof. The average molecular weight of the PEI may be at least 5,000, and more typically, at least 25,000, at least 50,000, at least 100,000, at least 150,000, at least 200,000, at least 250,000, at least 500,000, at least 750,000, at least 1,000,000, or at least 2,000,000.

The charge density of the PEI may be at least 10 meq/g, at least 11 meq/g, at least 12 meq/g, at least 13 meq/g, at least 14 meq/g, at least 15 meq/g, at least 16 meq/g, at least 17 meq/g, at least 18 meq/g, at least 19 meq/g, or at least 20 meq/g.

The concentration of PEI within the formulation may be not more than 5 wt. %, not more than 4 wt. %, not more than 3 wt. %, not more than 2 wt. %, not more than 1 wt. %, not more than 0.5 wt. %, not more than 0.4 wt. %, not more than 0.3 wt. %, not more than 0.2 wt. %, not more than 0.1 wt. %, not more than 0.05 wt. %, or not more than 0.01 wt. %.

The conditioning and resolubilizing agents may each individually be stable at a temperature of up to at least 100° C., at least 125° C., at least 150° C., at least 175° C., at least 200° C., or at least 225° C.

The resolubilizing agent may include, mainly include, or consist essentially of at least one sugar, at least one alcohol (e.g., diol, triol, polyol), at least one ether or polyether, at least one amine, at least one polymeric anion salt, at least one amino silicone, or combinations thereof (e.g., agents comprising combined sugar and ether, alcohol and amine functionalities or polyether and amine functionalities).

In some embodiments, the resolubilizing agent is selected from the group comprising cocoamide diethanol amine, ethoxylated methyl glucose ether (e.g., Glucam™ E-10 and Glucam™ E-20), glycerol, pentaerythritol, PEG 400, PEG 600, poly(sodium 4-styrenesulfonate), silicone having amine pendant groups (e.g., SilSense® Q-Plus Silicone having quaternary nitrogen and SilSense® A21 Silicone having secondary and tertiary amine groups), sucrose, triethanolamine, triethylene glycol mono methyl ether, and combinations thereof.

Conditioning compositions comprising conditioning agents and resolubilizing agents according to present teachings may further comprise one or more additive including pH modifiers, viscosity modifiers, stabilizers, preservatives, anti-oxidants, and chelating agents.

EXAMPLE 1

Conditioning Formulations

Exemplary conditioning solutions that can be used to treat an ITM upon which aqueous ink formulations can be deposited are provided hereinbelow, wherein the amount of the respective ingredients is provided in weight percent (wt. %) of the complete conditioning formulation, the water being deionized:

Conditioning Solution A

| | | |
|---|---|---|
| PEI Lupasol ® PS (BASF) | 1 | (MW 750,000, ~33% solid) |
| Sucrose | 4 | |
| Water | 95 | |

Conditioning Solution B

| | | |
|---|---|---|
| PEI Lupasol ® P (BASF) | 0.7 | (MW 750,000, ~50% solid) |
| Glycerol | 1 | |
| Water | 98.3 | |

Conditioning Solution C

| | | |
|---|---|---|
| PEI Lupasol ® HF (BASF) | 5 | (MW 25,000, ~56% solid) |
| Triethanolamine | 10 | |
| Water | 85 | |

Conditioning Solution D

| | | |
|---|---|---|
| PEI Lupasol ® WF (BASF) | 2 | (MW 25,000, ~99% solid) |
| Pentaerythritol | 1 | |
| Water | 97 | |

Conditioning Solution E

| | |
|---|---|
| PEI branched, MW 25,000 (Aldrich) | 3 |
| Polyethylene glycol 400 | 6 |
| Water | 91 |

Conditioning Solution F

| | |
|---|---|
| PEI, 80% ethoxylated MW 111,000, 37% water solution (Aldrich) | 4 |
| Glycerol | 4 |
| Water | 92 |

Conditioning Solution I

| | | |
|---|---|---|
| ViviPrint ™ 131 | 2 | (MW 1,500,000-2,000,000, ~11% solid) |
| Glycerol | 2 | |
| Water | 96 | |

Conditioning Solution J

| | | |
|---|---|---|
| ViviPrint ™ 131 | 2 | (MW 1,500,000-2,000,000, ~11% solid) |
| Water | 98 | |

Such conditioning solutions were typically prepared by mixing the conditioning agent with most of the water, adding then the resolubilizing agent and further stirring the mixture. Water was then added to complete the conditioning formulation up to 100 weight parts and the resulting formulation was optionally filtered through a 0.5 micrometer (μm) filter.

Such conditioning solutions can be prepared as concentrated stock to be diluted to the final concentration desired in operation of a relevant printing system. Exemplary concentrated stock of conditioning solutions that can be diluted and then used to treat an ITM upon which the ink formulations can be deposited are provided hereinbelow, wherein the amount of the respective ingredients are provided in weight percent (wt. %) of the stock:

Conditioning Stock Solution G

| | | |
|---|---|---|
| PEI Lupasol ® P (BASF) | 41.5 | (MW 750,000, ~50% solid) |
| Glycerol | 39 | |
| Water | 19.5 | |

Conditioning Stock Solution H

| | | |
|---|---|---|
| PEI, Lupasol ® PN-50 | 30.5 | (MW 1,000,000, ~49% solid) |
| Triethanolamine | 20.8 | |
| Water | 48.7 | |

EXAMPLE 2

Resolubilization of Dried Conditioning Formulations

The re-solubility of Solution I and Solution J was tested according to the following procedure: each sample (50 ml) was dried for 3 days at 100° C. The dried residue was resuspended with 50 ml of hot water (with heating to 60° C. to accelerate the experiment and to approximate the temperature of the ITM).

Results: the residue of Solution I dissolved almost immediately (in less than 1 second). By contrast, dissolution of Solution 1, which was devoid of a resolubilization agent, required 1 minute of intensive shaking.

Effect of Resolubilizing Agents on Resolubilization of Dried Conditioning Agents Once dried, various PEIs found to be generally suitable as conditioning agents do not easily resolubilize in water, even though such PEIs were water soluble or even highly water soluble, ab initio. Some guar-based and Viviprint conditioning agents may suffer from similar phenomena, albeit on a lesser scale.

The dried conditioning agent may therefore accumulate on the blanket, especially on areas on which no ink was jetted. Such areas may be appreciably more susceptible to the accumulation of the dried conditioning agent, with respect to printed-on areas, in which much or all of the dried conditioning agent may be transferred to the printing substrate, along with the ink image, upon impression thereof.

The inventive formulations improve resolubilization, or the kinetics of resolubilization, following drying.

In the experimental program provided below, the inventors assessed whether resolubilization agents (RA) could be added to a conditioning solution comprising, as a conditioning agent (CA), 0.3% wt. PEI to facilitate its resolubilization in water, following extensive drying.

The candidate Resolubilization Agents were selected have any of the following functional groups: —OH, —NH2, —$N^+R3$, —$SO^{3-}$.

Experimental Procedure:

The conditioning agent tested was PEI Lupasol® PS at 1:100 dilution (i.e., ~0.3% wt. concentration of PEI in the final conditioning composition).

The conditioning solutions were prepared in distilled water using a constant amount of CA (0.3% PEI Lupasol® PS) and increasing amounts of candidate RA at the weight ratio indicated below. The RA was typically at least 99% pure or used as provided by the commercial supplier. Chemicals were purchased from Ashland, Chemrez Technologies, Lubrizol and Sigma-Aldrich.

Conditioning solutions containing about 6 g of solid material were dried for 3 days at 100° C. The dried residue was resuspended with 50 ml of hot water (with heating to 60° C. to accelerate the experiment and to approximate the temperature of the ITM).

Resolubilization was visually assessed and classified either as positive, if visibly achieved, negative if not visibly achieved, or partial. A resuspended sample was classified as partly resoluble if found to contain a fractional quantity of undissolved dried residues. To the extent available, information concerning the estimated average molecular weight of the candidate Resolubilizing Agent, and the number of H-bonding group (meq/g) is also provided. The results are provided below in Table 1.

TABLE 1

| Resolubilizing Agent (RA)<br>Chemical Family<br>Chemical Formula | RA:CA Ratio | Resol. in water | MW | # of H-bonding Groups (meq/g) |
|---|---|---|---|---|
| Reference (PEI Alone) | 0:1 | No | | |
| Ethylene Glycol | 1:5 | No | 62.07 | 32 |
| Diol | 1:1 | No | | |
| $C_2H_6O_2$ | 5:1 | No | | |
| Propylene glycol | 1:5 | No | 76.09 | 26 |
| Diol | 1:1 | No | | |
| $C_3H_8O_2$ | 5:1 | No | | |
| Diethylene Glycol | 1:5 | No | 106.12 | 18 |
| Diol | 1:1 | No | | |
| $C_4H_{10}O_3$ | 5:1 | No | | |
| 2-Amino-2-methyl-1-propanol | 1:5 | No | 89.1 | 22 |
| Amine and Alcohol | 1:1 | No | | |
| $C_4H_{11}NO$ | 5:1 | No | | |
| PEG 8000 | 1:5 | No | ~8,000 | 0.25 |
| Polyether | 1:1 | No | | |
| $C_{2n}H_{4n+2}O_{n+1}$ | 5:1 | No | | |
| PEG 20000 | 1:5 | No | ~20,000 | 0.1 |
| Polyether | 1:1 | No | | |
| $C_{2n}H_{4n+2}O_{n+1}$ | 5:1 | No | | |
| PEG 400 | 1:5 | No | ~400 | 5 |
| Polyether | 1:1 | Partly | | |
| $C_{2n}H_{4n+2}O_{n+1}$ | 5:1 | Yes | | |
| Glycerol | 1:5 | No | 92.09 | 32 |
| Triol | 1:1 | Yes | | |
| $C_3H_8O_3$ | 5:1 | Yes | | |
| Triethanolamine | 1:5 | Partly | 149.19 | 27 |
| Amine AND Triol | 1:1 | Yes | | |
| $C_6H_{15}NO_3$ | 5:1 | Yes | | |
| Pentaerythritol | 1:5 | Partly | 136.15 | 29 |
| Polyol | 1:1 | Yes | | |
| $C_5H_{12}O_4$ | 5:1 | Yes | | |
| PVA—Polyvinyl alcohol | 1:5 | No | ~100,000 | |
| Polyol | 1:1 | No | | |
| $(C_2H_4O)_x$ | 5:1 | No | | |
| Poly(sodium 4-styrenesulfonate) | 1:5 | Part | ~70,000 | 4 |
| Polymeric Anion Salt | 1:1 | Yes | 206* | |
| $(C_8H_7NaO_3S)_n$ | 5:1 | Yes | | |
| Poly(diallyldimethylammoniumchloride) | 1:5 | No | ~500,000 | 6 |
| Polymeric Cation Salt | 1:1 | No | 161* | |
| $(C_8H_{16}NCl)_n$ | 5:1 | No | | |
| Sodium Chloride | 1:5 | No | 58 | 0 |
| Inorganic Salt | 1:1 | No | | |
| NaCl | 5:1 | No | | |
| Sucrose | 1:5 | Yes | 342 | 23 |
| Sugar | 1:1 | Yes | | |
| $C_{12}H_{22}O_{11}$ | 5:1 | Yes | | |
| ViviPrint ™ 131 | 1:5 | No | ~2,000,000 | 10 |
| ViviPrint ™ Vinyl based polymers | 1:1 | No | 296* | |
| Vinylpyrrolidone/ | 5:1 | No | | |
| Dimethylaminopropylmethacrylamide | | | | |
| Copolymer | | | | |
| ViviPrint ™ 200 | 1:5 | No | ~1,500,000 | 8 |
| ViviPrint ™ Vinyl based polymers | 1:1 | No | 443* | |
| Vinylcaprolactam/ | 5:1 | No | | |
| Dimethylaminopropylmethacrylamide/ | | | | |
| Hydroxyethylmethacrylate Terpolymer | | | | |
| ViviPrint ™ 650 | 1:5 | No | NA | 7 |
| ViviPrint ™ Vinyl based polymers | 1:1 | No | 407* | |
| Quaternized Vinylpyrrolidone | 5:1 | No | | |
| Dimethylaminoethyl Methacrylate | | | | |
| Copolymer | | | | |
| Nhance ™ 3000 | 1:5 | No | NA | NA |
| Cationic Guar | 1:1 | No | | |
| | 5:1 | No | | |

TABLE 1-continued

| Resolubilizing Agent (RA)<br>Chemical Family<br>Chemical Formula | RA:CA Ratio | Resol. in water | MW | # of H-bonding Groups (meq/g) |
|---|---|---|---|---|
| Nhance ™ 3196<br>Cationic Guar | 1:5<br>1:1<br>5:1 | No<br>No<br>No | NA | NA |

*molecular weight of one single unit

EXAMPLE 3

Vapor Pressure Measurement Procedure

Vapor pressure or equilibrium vapor pressure is the pressure exerted by a vapor in thermodynamic equilibrium with its condensed phases (solid or liquid) at a given temperature in a closed system. The equilibrium vapor pressure is an indication of a liquid's evaporation rate and relates to the tendency of particles to escape from the liquid or solid they are part of. A substance with a low vapor pressure at a temperature of interest is considered non-volatile. If the vapor pressure of a material at a temperature of interest is not provided by the supplier of such compound, this characteristic can be assessed as follows.

Vapor pressure can be measured using a conventional thermogravimetric equipment according to a method described by Duncan M. Price in Thermochimica Acta 367-368 (2001) 253-262.

The relationship between volatilization rate and vapor pressure may be described by the Langmuir equation for free evaporation:

$$-\frac{dm}{dt} = px\sqrt{\frac{M}{2\pi RT}}$$

where dm/dt is the rate of mass loss per unit area, p the vapor pressure, M the molecular weight of the effusing vapor, R the gas constant, T the absolute temperature and $\alpha$ is the vaporization coefficient.

The equipment is calibrated and the coefficient $\alpha$ is found using a pure reference material (n-decane) of known vapor pressure.

Measurements are carried out using thermobalances. Samples are placed in aluminum sample cups of the type used for DSC measurements. For solid samples, the cup is filled completely with material, which is then melted so that a known sample surface area is obtained. Liquid samples are measured directly.

Measurements are carried out in an inert atmosphere, under isothermal conditions at increasing temperatures, using continuous heating for 180 minutes. The rate of mass loss at a constant temperature is found for each tested material and serves for calculation of the vapor pressure. Vapor pressure (kPa) of selected materials at 70, 90 and 110° C. are reported below in Table 2, together with literature values when available.

TABLE 2

| Resolubilizing Agent (RA)<br>Chemical Family<br>Chemical Formula | Boiling Point (° C.) | Vapor pressure at 70° C. (kPa) | Vapor pressure at 90° C. (kPa) | Vapor pressure at 110° C. (kPa) |
|---|---|---|---|---|
| Reference (PEI Alone) | | | | |
| Ethylene Glycol<br>Diol<br>$C_2H_6O_2$ | 197.3 | | | |
| Propylene glycol<br>Diol<br>$C_3H_8O_2$ | 188.2 | 0.625 | 1.375 | 5.375 |
| Diethylene Glycol<br>Diol<br>$C_4H_{10}O_3$ | 245 | 0.0125 | 0.0125 | 0.0625 |
| 2-Amino-2-methyl-1-propanol<br>Amine and Alcohol<br>$C_4H_{11}NO$ | 165 | 0.075 | 0.2 | 0.75 |
| PEG 8,000<br>Polyether<br>$C_{2n}H_{4n+2}O_{n+1}$ | >300 | <0.01 | <0.01 | <0.01 |
| PEG 20,000<br>Polyether<br>$C_{2n}H_{4n+2}O_{n+1}$ | >300 | <0.01 | <0.01 | <0.01 |
| PEG 400<br>Polyether<br>$C_{2n}H_{4n+2}O_{n+1}$ | >250 | <0.01 | <0.01 | <0.01 |
| Glycerol<br>Triol<br>$C_3H_8O_3$ | 290 | 0.004 | 0.019 | 0.05 |

TABLE 2-continued

| Resolubilizing Agent (RA)<br>Chemical Family<br>Chemical Formula | Boiling Point (° C.) | Vapor pressure at 70° C. (kPa) | Vapor pressure at 90° C. (kPa) | Vapor pressure at 110° C. (kPa) |
|---|---|---|---|---|
| Triethanolamine<br>Amine And Triol<br>$C_6H_{15}NO_3$ | 335 | <0.01 | <0.01 | <0.01 |
| Pentaerythritol<br>Polyol<br>$C_5H_{12}O_4$ | 276 at 30 mmHg | <0.01 | <0.01 | <0.01 |
| PVA—Polyvinyl alcohol<br>Polyol<br>$(C_2H_4O)_x$ | >300 | <0.01 | <0.01 | <0.01 |
| Poly(sodium 4-styrenesulfonate)<br>Polymeric Anion Salt<br>$(C_8H_7NaO_3S)_n$ | >300 | <0.01 | <0.01 | <0.01 |
| Poly(diallyldimethylammoniumchloride)<br>Polymeric Cation Salt<br>$(C_8H_{16}NCl)_n$ | >300 | <0.01 | <0.01 | <0.01 |
| Sodium Chloride<br>Inorganic Salt<br>NaCl | >300 | <0.01 | <0.01 | <0.01 |
| Sucrose<br>Sugar<br>$C_{12}H_{22}O_{11}$ | >300 | <0.01 | <0.01 | <0.01 |
| ViviPrint ™ 131<br>ViviPrint ™ Vinyl based polymers<br>Vinylpyrrolidone/<br>Dimethylaminopropylmethacrylamide<br>Copolymer | >300 | <0.01 | <0.01 | <0.01 |
| ViviPrint ™ 200<br>ViviPrint ™ Vinyl based polymers<br>Vinylcaprolactam/<br>Dimethylaminopropylmethacrylamide/<br>Hydroxyethylmethacrylate Terpolymer | >300 | <0.01 | <0.01 | <0.01 |
| ViviPrint ™ 650<br>ViviPrint ™ Vinyl based polymers<br>Quaternized Vinylpyrrolidone<br>Dimethylaminoethyl Methacrylate<br>Copolymer | >300 | <0.01 | <0.01 | <0.01 |
| Nhance ® 3000<br>Cationic Guar | >300 | <0.01 | <0.01 | <0.01 |
| Nhance ® 3196<br>Cationic Guar | >300 | <0.01 | <0.01 | <0.01 |

* molecular weight of one single unit

EXAMPLE 4

Effect of Resolubilizing Agent on Resolubility of Conditioning Compositions Dried at 200° C.

Whereas in previous experiments, conditioning solutions containing about 6 g of solid material were dried for 3 days at 100° C. and the dried residues resuspended with 50 ml of 60° C. hot water, in the present study a smaller sample was exposed to higher temperatures for a shorter period of time.

A conditioning composition comprising 1.65% polyethylenimine (PEI) in distilled water (1:20 dilution of BASF Lupasol® PS having a solid content of 33 wt. %) served as control (CC0). The following resolubilizing agents were tested, each added to the control solution at a final concentration of 10 wt. %, and the resulting conditioning compositions (CC) were referred to as CCN, N being the number below assigned to each resolubilizing agent. For example, CC0 was prepared by adding 5 g of PEI to 95 g of water, whereas CC1 was prepared by mixing 10 g of Glycerol (no. 1) and 5 g of PEI in 85 g of water.

| | | |
|---|---|---|
| 1 | Glycerol | (Sigma-Aldrich, >99% pure) |
| 2 | Triethanolamine (TEA) | (Sigma-Aldrich, >99% pure) |
| 3 | Polyethylene glycol (PEG) 400 | (Sigma-Aldrich, MW 380-420) |
| 4 | Polyethylene glycol 600 | (Sigma-Aldrich, MW 570-630) |

The mixtures were stirred to homogeneity and the samples so prepared were tested as follows: 1 ml of each sample was placed on a circular watch glass and placed into an oven heated to 200° C. The samples were left to dry either 30 minutes or 3 hours. The dried residues of the conditioning compositions were then cooled to 60° C. and resuspended in 5 ml of hot water (heated to 60° C. to accelerate the experiment).

Resolubilization was visually assessed and classified either as positive, if visibly achieved, negative if not visibly achieved, or partial. A resuspended sample was classified as partly resoluble if found to contain a fractional quantity of undissolved dried residues.

The experiment was repeated three times for each test samples and the results were summarized in the Table 3.

TABLE 3

| Sample | RA | Resolubilization of CC dried at 200° C. for 30 minutes | 3 hours |
|---|---|---|---|
| Control CC0 | None | No | No |
| CC1 | Glycerol | No | No |
| CC2 | TEA | No | No |
| CC3 | PEG 400 | Yes | Partly |
| CC4 | PEG 600 | Yes | Yes |

EXAMPLE 5

Effect of Resolubilizing Agent on Resolubility of Conditioning Compositions on Printing Blanket In order to assess the effect of the resolubilizing agent under conditions more relevant to printing systems, the following experimental setup 100 was devised: an elongate strip of printing blanket 102 was mounted and attached to a rotatable cylinder 104, and the ends of the blanket strip were secured one to the other, forming a seam 106. The cylinder was positioned so that its lower section was in contact (for about 0.5 to 1.0 second) with the conditioning compositions 108 being tested, placed in a receiving vessel 110. The temperature of composition 108 can be monitored and/or maintained as desired. During each cycle, the blanket was sequentially coated with the test solution, wiped of excess liquid by a polyurethane rubber wiper 112, dried with an air blower (>200° C.) 114 positioned about 12 cm from the blanket surface, further dried with an infrared (IR) lamp (~150° C.) 116 positioned about 9 cm away, before reentering the test solution for another cycle. The temperature on the outer surface of the blanket was monitored with an IR gun thermometer and depending on the position relative to the dipping or drying stages, varied between about 100° C. and about 140° C. The temperature of the condition composition tested was about 50° C. Depending on the speed of rotation and size of cylinder, the blanket coated with the tested conditioning solution was dried for a desired duration. The number of cycles was monitored and the cylinder stopped when the desired number of cycles was completed, at which time the rotation was stopped. The blanket was then removed and the accumulation of the conditioning composition under study was assessed. This was done by measuring the thickness of the dried agents above the surface of the blanket using a confocal microscope (LEXT at ×20 magnification and laser scan). The results illustrate the accumulation of conditioning agent in the presence, or absence, of the resolubilizing agent being tested.

In this example, a conditioning composition comprising about 0.33 wt. % polyethylenimine (PEI) in distilled water (1:100 dilution of BASF Lupasol® PS having a solid content of 33 wt. %) served as reference. Unless otherwise stated, the resolubilizing agents were added to the reference composition at a final concentration of 1 wt. %, In the following experiments, the blanket comprised a body for support and a release layer formed thereupon by condensation curing of silanol-terminated polydimethyl siloxane silicone (PDMS), as described in PCT Publication No. WO 2013/132438, which is incorporated herein by reference. As the rotational speed of the cylinder (330 rph) was relatively low, the blanket was exposed to the conditioning compositions and subjected to drying for a duration of time that may be more extensive than in typical commercial printing conditions. For instance, the conditioned blankets were submitted to similar drying periods of 1.5-2 seconds per cycle. Moreover, as no ink images were applied and transferred to paper, steps which would have peeled at least part of the conditioning residues, if not all, it is believed that the above-described laboratory setup can simulate unfavorable conditions. It is to be noted that the pattern of the dried splotches of conditioning compositions in this setup was found to be similar to the accumulations that could be observed in larger scale commercial printing setup in which ink images were jetted upon the conditioned blankets.

Figure 2:
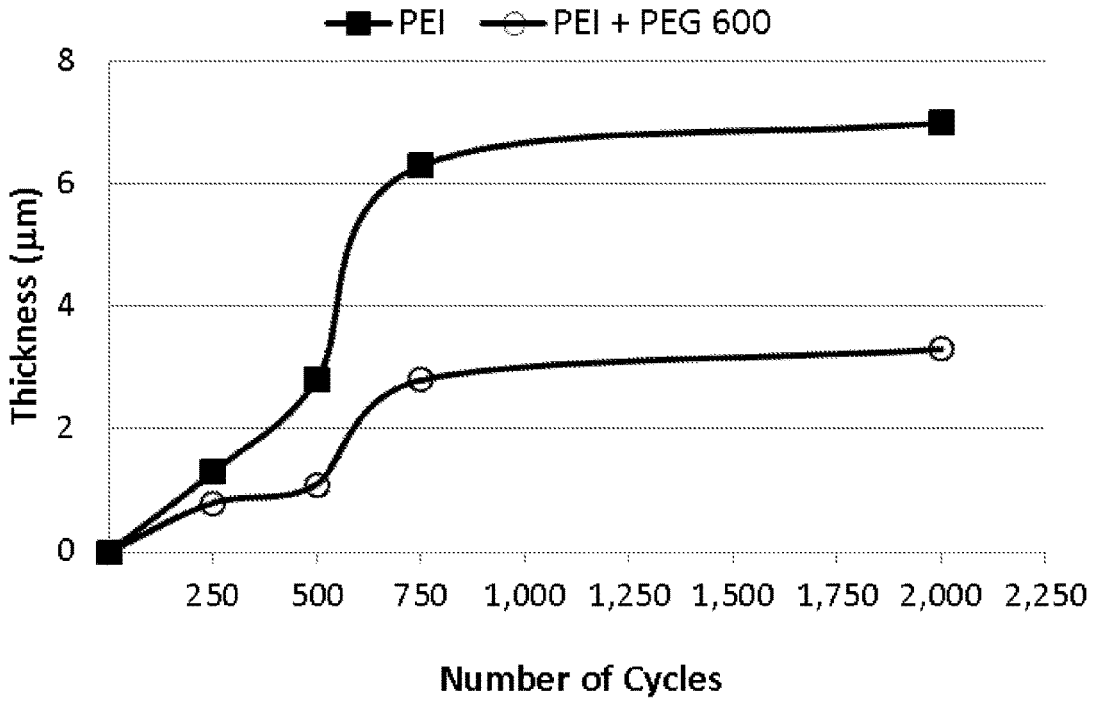
FIG. 2 is a plot showing the measured thickness of dried conditioning compositions as a function of the number of cycles of rotation of a printing blanket in an apparatus as illustrated in FIG. 1.

Measurements were performed on at least three representative splotches, and the average thickness (in micrometers) is reported in the Table 4, in which the effect of 1 wt. % of PEG 600 on the PEI reference is assessed. The relative effect of the tested RA was calculated as a percent of decreased thickness as compared to the maximal thickness of CA in the absence of RA. The results are displayed in FIG. 2.

TABLE 4

| No. of Cycles | Reference: PEI | PEI + PEG 600 | Thickness Reduction |
|---|---|---|---|
| 250 | 1.3 μm | 0.8 μm | 38.5% |
| 500 | 2.8 μm | 1.1 μm | 60.7% |
| 750 | 6.3 μm | 2.8 μm | 55.5% |
| 2000 | 7.0 μm | 3.3 μm | 52.8% |

The positive effect of PEG 600 in reducing accumulation of PEI on the tested printing blanket was further corroborated by measuring the gloss of the printing, blanket, using a BYK micro-gloss 75 gloss meter at the beginning and end of the experiment. The gloss was found to be at first 88 Gloss Units (GU), when the blanket strip was new at cycle zero. After 2000 cycles, a blanket exposed to the reference conditioning composition of only PEI displayed a gloss of 75 GU, corresponding to a decrease of about 15%. After the same number of cycles, the blanket exposed to PEI+PEG 600 displayed substantially the same gloss as the baseline, namely 88 GU. These results further support the "protective" effect of this RA under the tested conditions.

Similar blanket coating experiments were performed with additional RAs including amino silicones (SilSense® Q-Plus Silicone and SilSense® A21 Silicone; Lubrizol) cocoamide diethanolamine (Fil Amide 182 of Chemrez Technologies), ethoxylated methyl glucose ethers (Glucam™ E-10 and Glucan™ E-20; Lubrizol), PEG 400 and triethylene glycol monomethyl (TGME; Sigma-Aldrich), All displayed satisfactory outcomes, reducing the accumulation of reference PEI over time. Average thicknesses as measured after 250 cycles in apparatus 100 are provided in Table 5.

TABLE 5

| Conditioning Composition | Average Thickness | Thickness Reduction |
|---|---|---|
| Reference: PEI | 1.3 μm | 00.0% |
| PEI + cocoamide DEA | 1.0 μm | 23.1% |
| PEI + Glucam ™ E-10 | 0.9 μm | 30.8% |
| PEI + Glucam ™ E-20 | 0.7 μm | 46.1% |
| PEI + PEG 400 | 1.2 μm | 07.7% |
| PEI + PEG 600 | 0.8 μm | 38.5% |
| PEI + SilSense ® Q-Plus | 0.4 μm | 69.2% |
| PEI + SilSense ® A21 | 0.7 μm | 46.1% |
| PEI + TGME | 1.1 μm | 15.4% |
| PEI + Sorbitol | 1.3 μm | 00.0% |

As used herein in the specification and in the claims section that follows, the term "hydrogen-bonding functional group" is used as the term would normally be understood by those of skill in the art.

As used herein in the specification and in the claims section that follows, the term "intimately mixed", with regard to a formulation component disposed in a carrier liquid of the formulation, is meant to include dissolution of the component and/or dispersion of the component within the carrier liquid.

As used herein in the specification and in the claims section that follows, the term "ratio", as used herein in the specification and in the claims section that follows, refers to a weight ratio, unless specifically indicated otherwise.

As used herein in the specification and in the claims section that follows, the term "largely includes", with respect to a component within a formulation, refers to a weight content of at least 45%.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons skilled in the art to which the invention pertains.

In the description and claims of the present disclosure, each of the verbs, "comprise" "include" and "have", and conjugates thereof, are used to indicate that the object or objects of the verb are not necessarily a complete listing of members, components, elements or parts of the subject or subjects of the verb. As used herein, the singular form "a", "an" and "the" include plural references unless the context clearly dictates otherwise. For example, the term "an impression station" or "at least one impression station" may include a plurality of impression stations.

Although the invention has been described in conjunction with specific embodiments thereof it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification, including are hereby incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A formulation for use with an intermediate transfer member of a printing system, the formulation comprising:

(a) a carrier liquid;

(b) a positively chargeable polymeric chemical agent selected from the group consisting of polyethylene imine, a cationic guar or guar-based polymer and a cationic methacrylamide or methacrylamide-based polymer; and (c) a resolubilizing agent selected to improve resolubilization of said chemical agent;

said polymeric chemical agent and said resolubilizing agent disposed within said carrier liquid;

said polymeric chemical agent having an average molecular weight of at least 10,000 and a positive charge density of at least 0.1 meq/g;

said resolubilizing agent having a hydrogen-bonding functional group;

said resolubilizing agent having, in a pure state and at 90° C., a vapor pressure of less than 0.5 kPa;

the concentration of the polymeric chemical agent within the formulation being not more than 1 wt. %;

and wherein a weight ratio of said resolubilizing agent to said polymeric chemical agent, within the formulation, is at least 1:10 and less than 2:1.

2. The formulation of claim 1, said concentration of said polymeric chemical agent within the formulation being not more than 0.5 wt. %.

3. The formulation of claim 1, wherein a functional group density of said hydrogen-bonding functional group within said resolubilizing agent is at least 0.25 meq/g.

4. The formulation of claim 1, said resolubilizing agent having at least one functional group selected from the group consisting of an amine group, a sulfonate group, and combinations thereof.

5. The formulation of claim 1, said resolubilizing agent being selected from the group consisting of sugars amino silicones, styrene sulfonates, and combinations thereof.

6. The formulation of claim 1, said resolubilizing agent being selected from the group consisting of cocoamide diethanol amine, ethoxylated methyl glucose ether, pentaerythritol, PEG 400, PEG 600, poly(sodium-4-styrenesulfonate), sucrose, triethanol amine, and triethylene glycol monomethyl ether.

7. The formulation of claim 1, said resolubilizing agent having a molecular weight below 5,000 and optionally, having a solubility, in the formulation, of at least 10%.

8. The formulation of claim 1, a water content of the formulation being at least 60% by weight.

9. The formulation of claim 1, said weight ratio of said resolubilizing agent to said polymeric chemical agent being at least 1:3.

10. The formulation of claim 1, the formulation having a viscosity of at most 1,500 cP.

11. The formulation of claim 1, said vapor pressure of said resolubilizing agent being less than 0.20 kPa.

12. The formulation of claim 1, said resolubilizing agent and said formulation being each independently stable at a temperature of up to at least 125° C.

13. The formulation of claim 1, said polymeric chemical agent including at least one of linear polyethylene imine, branched polyethylene imine, and modified polyethylene imine; and, optionally, said polymeric chemical agent having at least one of the following structural properties: (a) said positive charge density being at least 3 meq/g and said average molecular weight being at least 5,000; (b) said positive charge density being at least 3 meq/g and said average molecular weight being at least 1000; (c) said average molecular weight being at least 50,000; and (d) a nitrogen content of at least 18% and said average molecular weight of at least 10,000.

14. The formulation of claim 13, the charge density of said polyethylene imine being at least 10 meq/g.

15. The formulation of claim 1, said polymeric chemical agent having at least one of the following structural properties: (a) said positive charge density being at least 3 meq/g and said average molecular weight being at least 5,000; (b) said positive charge density being at least 3 meq/g and said average molecular weight being at least 1000; (c) said average molecular weight being at least 50,000; and (d) a nitrogen content of at least 18% and said average molecular weight of at least 10,000, and wherein said polymeric chemical agent selected from the group consisting of a vinyl pyrrolidone-dimethylaminopropyl methacrylamide co-polymer, a vinyl caprolactam-dimemylaminopropyl methacrylamide hydroxyethyl methacrylate terpolymer, a quaternized copolymer of vinyl pyrrolidone and dimethylaminoethyl methacrylate with diethyl sulfate, a guar hydroxypropyltrimonium chloride, a hydroxypropyl guar hydroxypropyltrimonium chloride, and combinations thereof.

16. The formulation of claim 1, said resolubilizing agent having a solubility, in the formulation, of at least 1%, at 25° C.

17. The formulation of claim 1, said polymeric chemical agent, said resolubilizing agent, and said carrier liquid making up at least 80% of the formulation, by weight.

18. A method comprising:

(a) providing a formulation according to claim 1;

(b) treating an intermediate transfer member of a printing system by application of said formulation upon a release surface of said intermediate transfer member;

(c) thereafter, depositing an ink image upon said intermediate transfer member, (d) drying said ink image deposited on said intermediate transfer, and (e) transferring the dried ink image to a printing substrate.

* * * * *